US009885465B2

(12) United States Patent
Nguyen

(10) Patent No.: US 9,885,465 B2
(45) Date of Patent: Feb. 6, 2018

(54) ILLUMINATION DEVICES

(71) Applicant: Ultralight Optics, Inc., Costa Mesa, CA (US)

(72) Inventor: Ronald C. Nguyen, Fountain Valley, CA (US)

( * ) Notice: Subject to any disclaimer, the term of this patent is extended or adjusted under 35 U.S.C. 154(b) by 172 days.

(21) Appl. No.: 14/703,513

(22) Filed: May 4, 2015

(65) Prior Publication Data

US 2016/0327246 A1 Nov. 10, 2016

(51) Int. Cl.
*F21V 21/084* (2006.01)
*F21L 4/06* (2006.01)
*F21W 131/20* (2006.01)

(52) U.S. Cl.
CPC ..... *F21V 21/084* (2013.01); *F21L 4/06* (2013.01); *F21W 2131/20* (2013.01)

(58) Field of Classification Search
CPC ..... F21V 21/084; F21L 4/06; F21W 2131/20
See application file for complete search history.

(56) References Cited

U.S. PATENT DOCUMENTS 769,420 A 9/1904 Watch
2,902,216 A 10/1908 Dräger
933,499 A 9/1909 Taylor
994,094 A 5/1911 Eaton
1,019,895 A 3/1912 Hays et al.
1,901,180 A 3/1933 McBride
2,638,532 A * 5/1953 Brady ..... G02C 11/04 280/438.1
3,676,664 A 7/1972 Corvetti
3,683,168 A * 8/1972 Tatje ..... F21L 4/005 351/158
4,092,704 A 5/1978 Malm
4,794,496 A 12/1988 Lanes et al.
5,608,808 A 3/1997 da Silva
6,233,971 B1 * 5/2001 Ohlund ..... A44C 15/0015 362/104
7,175,295 B2 2/2007 Bretz et al.
7,281,826 B2 10/2007 Huang
7,500,747 B2 * 3/2009 Howell ..... G02C 11/06 351/158
7,513,660 B2 4/2009 Spartano et al.
7,581,833 B2 * 9/2009 Howell ..... G02C 5/143 351/121
7,621,634 B2 11/2009 Howell et al.
7,690,806 B2 4/2010 Feinbloom et al.
(Continued)

OTHER PUBLICATIONS

Snap on Optics website, http://www.snaponoptics.com, retrieved Mar. 18, 2015.

*Primary Examiner* — Mary Ellen Bowman

(57) ABSTRACT

Illumination devices are described. In one embodiment, an illumination device includes a light configured to be coupled to eyewear or a mask, such as a surgical loupe or a dental loupe. The illumination device also includes a battery configured to be coupled to the light. The light and the battery may be connected by a light connector and a battery connector. The illumination device also includes a battery coupling device coupled to the battery. The battery coupling device may be configured to couple the battery to a body part of a user. For example, the battery coupling device may include arms that wrap around a back of a head of a user, and grip or hold the sides of a head of a user.

11 Claims, 7 Drawing Sheets

(56) References Cited

U.S. PATENT DOCUMENTS

| | | | | |
|---|---|---|---|---|
| 7,708,421 | B2 | 5/2010 | Underdown et al. | |
| 8,081,262 | B1 * | 12/2011 | Perez | A61F 9/023 2/8.1 |
| 8,094,858 | B2 | 1/2012 | Thiel et al. | |
| 2004/0136178 | A1 * | 7/2004 | Yu | F21V 21/0885 362/103 |
| 2005/0174753 | A1 * | 8/2005 | Cao | A42B 3/044 362/106 |
| 2005/0276036 | A1 | 12/2005 | Miles et al. | |
| 2007/0046889 | A1 | 3/2007 | Miller et al. | |
| 2008/0310145 | A1 | 12/2008 | Blake et al. | |
| 2012/0120636 | A1 | 5/2012 | Wilt et al. | |
| 2014/0362561 | A1 * | 12/2014 | Faircloth | G02C 11/04 362/103 |

* cited by examiner

ILLUMINATION DEVICES

BACKGROUND

Illumination devices may be used in the medical and dental fields to illuminate an area of interest. Illumination devices may be coupled to surgical loupes, dental loupes, masks, and other equipment or articles worn on the face or head.

Illumination devices having a light worn on the face or head may use a battery which is attached at the waist or other lower part of the body. These illumination devices use wires which extend between the light and the battery. These wires are long enough to become entangled in other equipment, detach from the light and/or battery, or render askew eyewear or other equipment worn on the face or head.

Illumination devices having a light and a battery may use connectors which require manual alignment and coupling. This manual alignment may be difficult to perform with gloves, in poorly lit conditions, or in areas that cannot be viewed directly by a user.

What is needed is an illumination device which does not require the use of wires extending from the face or head to the lower body. What is needed is an illumination device with connectors which reduce the need for manual alignment and coupling.

SUMMARY

Illumination devices are described. In one embodiment, an illumination device comprises a light configured to be coupled to a head of a user. The light may include a light connector. The illumination device also comprises a battery configured to be coupled to the light. The battery may include a battery connector. The illumination device also comprises a battery coupling device coupled to the battery. The battery coupling device may be configured to couple the battery to a body part of a user.

DESCRIPTION

Figure 1A:
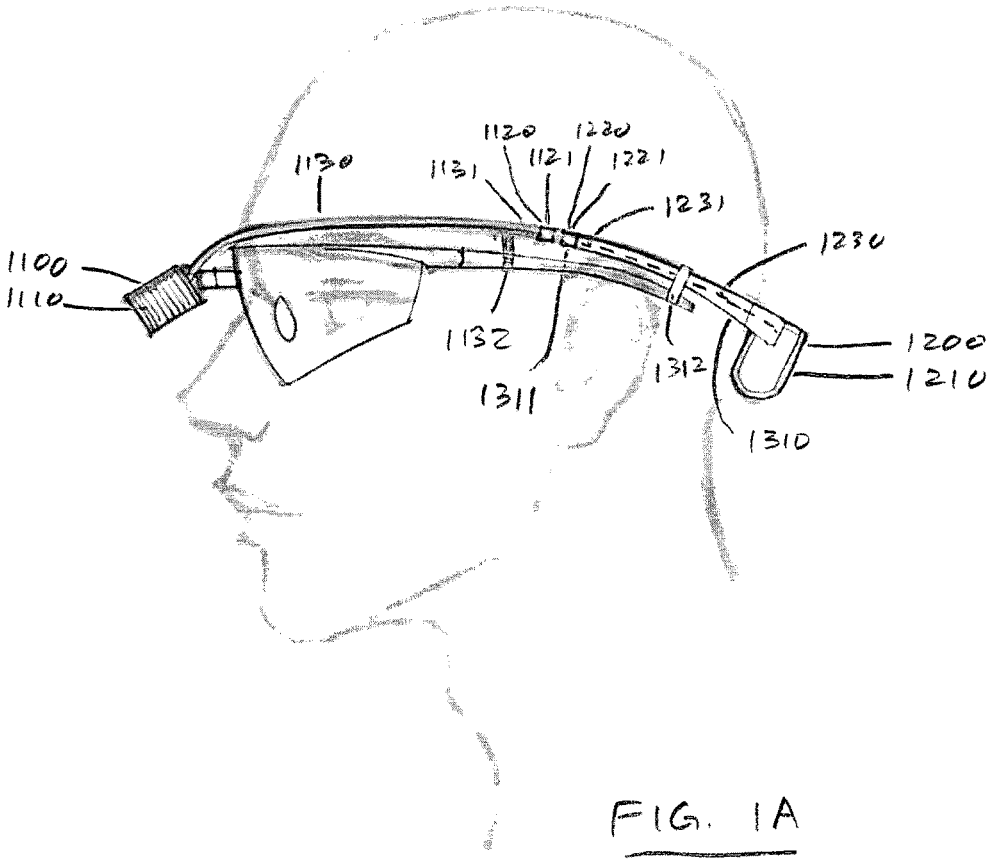
FIGS. 1A-1C show one embodiment of an illumination device 1000.
Figure 1B:
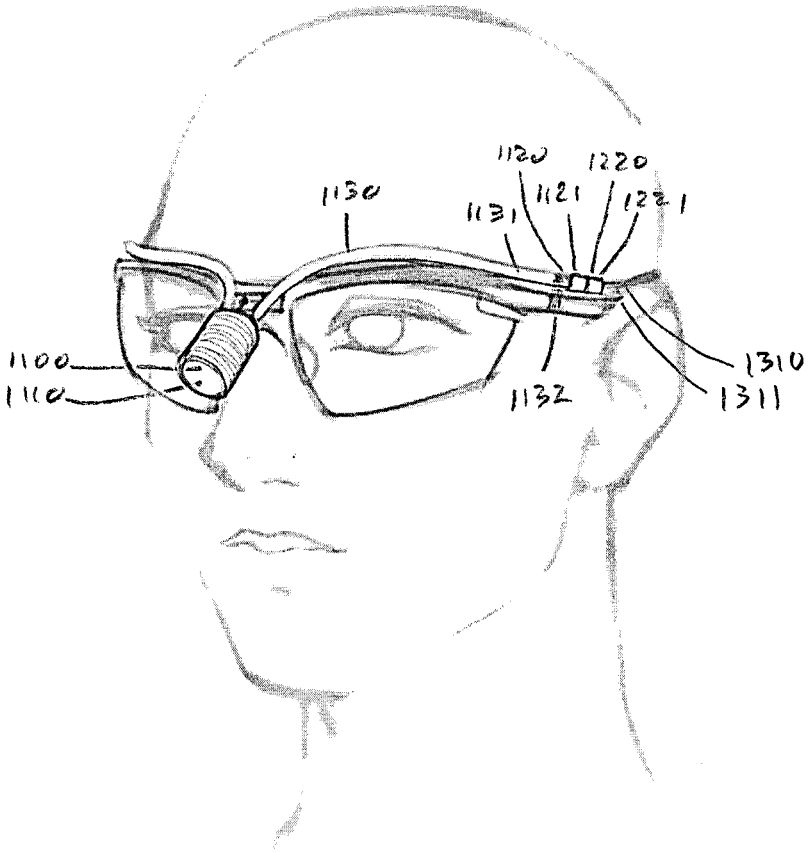
Figure 1C:
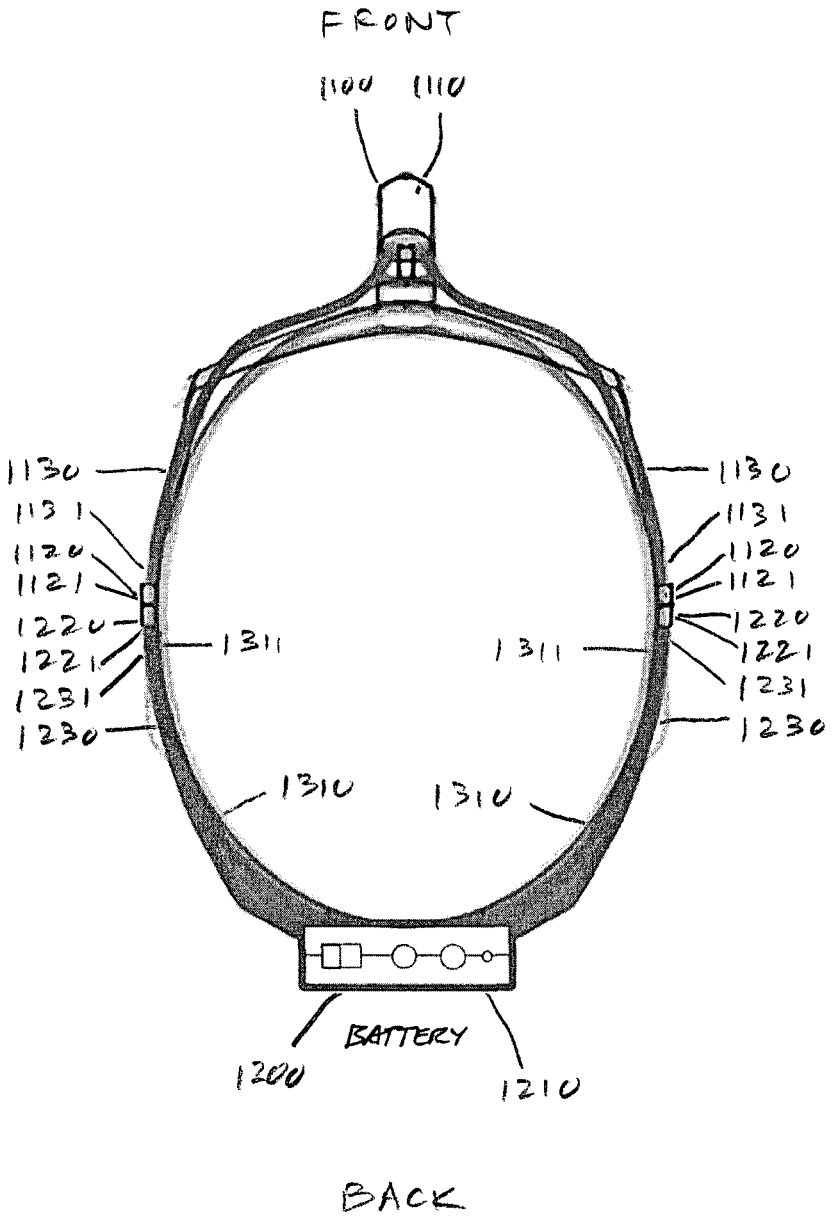

FIGS. 1A-1C show one embodiment of an illumination device 1000. FIG. 1A shows a side view of illumination device 1000. FIG. 1B shows a front view of illumination device 1000. FIG. 1C shows a top view of illumination device 1000.

Illumination device 1000 may include a light 1100, a battery 1200, and a battery coupling device 1300.

Light 1100 may be configured to be coupled to eyewear, such as a surgical loupe or a dental loupe. Alternatively, light 1100 may be configured to be coupled to a mask, headwear, or any other article worn on the face or head. Light 1100 may include a light housing 1110. Light 1100 may include a light connector 1120. Light 1100 may include a light connector 1120. Light connector 1120 may include a magnetic connector 1121. Alternatively, light connector 1120 may include a mechanical connector such as a male or female jack, or any other suitable connector. Light 1100 may include a light wire 1130. Light connector 1120 may be coupled to an end 1131 of light wire 1130. Alternatively, light connector 1120 may be part of light housing 1110. Light wire 1130 may be coupled to eyewear by one or more clips 1132. Light connector 1120 and light wire 1130 may be configured to include one or more electrical couplings.

Battery 1200 is configured to be coupled to light 1100. Battery 1200 may include an alkaline, nickel metal hydride, lithium ion, or any other suitable battery. Alternatively, battery 1200 may include any suitable power source. Battery 1200 may include a battery housing 1210. Battery 1200 may include a battery connector 1220. Battery connector 1220 may include a magnetic connector 1221. Alternatively, battery connector 1220 may include a mechanical connector such as a male or female jack, or any other suitable connector. Battery connector 1220 may be configured to be coupled to light connector 1120. Battery 1200 may include a battery wire 1230. Battery connector 1220 may be coupled to an end 1231 of battery wire 1230. Battery connector 1220 and battery wire 1230 may be configured to include one or more electrical couplings.

Battery coupling device 1300 is configured to be coupled to battery 1200. Battery coupling device 1300 may be separate from battery 1200, or formed integrally with battery 1200. Battery coupling device 1300 may be configured to be coupled to a user, such as the head, neck, or any other body part of a user. Battery coupling device 1300 may be configured so that it does not fully encircle a body part of a user. Battery coupling device 1300 may be configured to grip or hold opposite sides of a body part of a user, such as opposite sides of a head of a user or opposite sides of a neck of a user, with sufficient force to keep battery 1200 in position, yet still be removable without the need for undoing any kind of fastener. This may facilitate the wearing and removal of battery coupling device 1300 by a user, including facilitating the wearing and/or removal by using only one hand. Alternatively, battery coupling device 1300 may fully encircle a body part of a user.

Battery coupling device 1300 may be configured to wrap around a back of a body part of a user, such as a back of a head of a user or a back of a neck of a user. Battery coupling device 1300 may be configured to position or hold battery 1200 in a vicinity of an anterior portion or back part of a body part of a user, such as behind a head of a user or behind a neck of a user. This helps to keep battery 1200 out of the way when in use, and may act as a counterbalance to light 1100.

Alternatively, battery coupling device 1300 may be configured to wrap around a top of a body part of a user, such as a top of a head of a user, or any other portion of a body part of a user. Alternatively, battery coupling device 1300 may be configured to position or hold battery 1200 in a vicinity of a superior portion of a body part of a user, such as on top of a head of a user, or any other portion of a body part of a user, such as a side of a head of a user.

Battery coupling device 1300 may be configured to fit over the ears of a user. Battery coupling device 1300 may be configured to hook the ears of a user, such as over the outer ears of a user or into the inner ears of a user. This may help battery coupling device 1300 to be more securely coupled to a user.

In one embodiment, battery coupling device 1300 may include one or more arms 1310. Arms 1310 may be configured to be coupled to battery 1200. Arms 1310 may be configured to grip and hold opposite sides of a head of a user with sufficient force to keep battery 1200 in position behind a head of a user, yet still be removable without the need for undoing any kind of fastener. Arms 1310 may extend from battery 1200 to wrap around a back part of a head of a user. Arms 1310 may include arm ends 1311 at or near the sides of a head of a user, such as above the ears of a user. Arms 1310 may be curved or arcuate. Arms 1310 may be shaped to conform to a body part of a user, such as a head of a user or a neck of a user. Arms 1310 may come in different sizes to fit different users, and with varying grip or hold forces. Arms 1310 may be made of metal, plastic, wood, or any other suitable material. Arms 1310 may be flexible and bendable, with the gripping force provided by the arms 1310 themselves. Alternatively, arms 1310 may be rigid, with the gripping force provided by a spring or other device coupled to the arms.

Battery connectors 1220 may be coupled at or near one or more arm ends 1311. Battery connectors 1220 may be formed separately or integrally with arm ends 1311. Arms 1310 may be coupled to eyewear by one or more clips 1312. Clips 1312 are optional, and may at least partially hold in place or stabilize arms 1310. Battery wires 1230 may be coupled to run along the outside of arms 1310, or may be coupled to run at least partially inside arms 1310. Light wires 1130 may be configured to be long enough so that light connectors 1120 reach and may be coupled with battery connectors 1220.

Figure 2A:
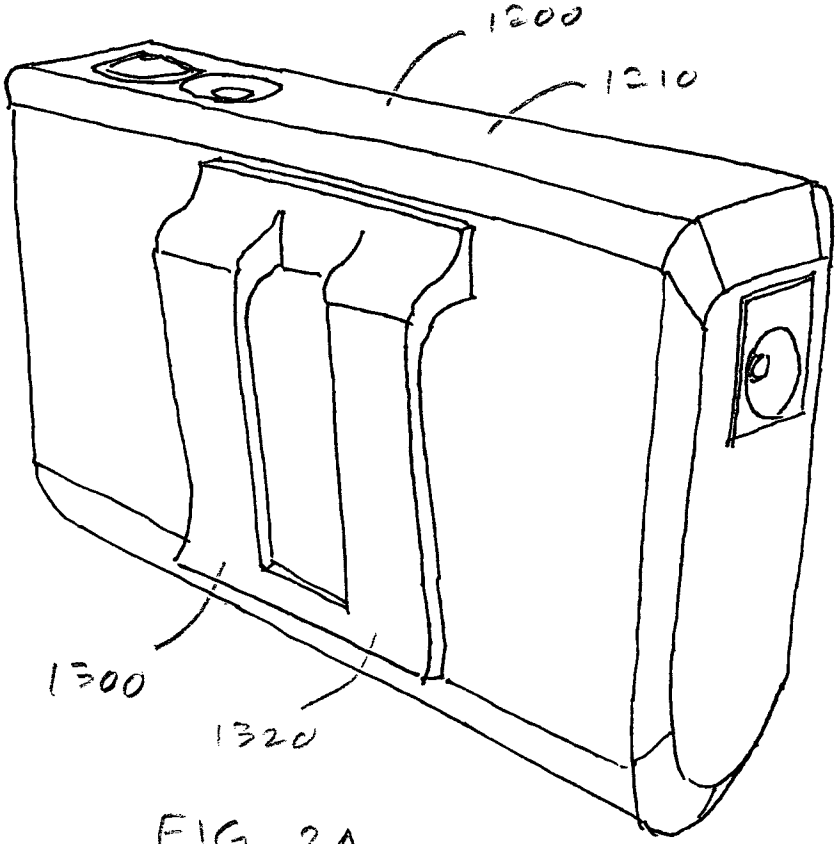
FIGS. 2A-2B show other embodiments of an illumination device 1000 and a battery coupling device 1300.

FIG. 2A shows another embodiment of an illumination device 1000 and a battery coupling device 1300. Battery coupling device 1300 may be configured to be coupled to an item worn by a user, such as a shirt, shirt collar, hat, or other article of clothing. Battery coupling device 1300 may include a clip 1320. Clip 1320 may be configured to be secured to an item worn by a user, such as a shirt or shirt collar. Clip 1320 may be configured to secured to hair of a user.

Figure 2B:
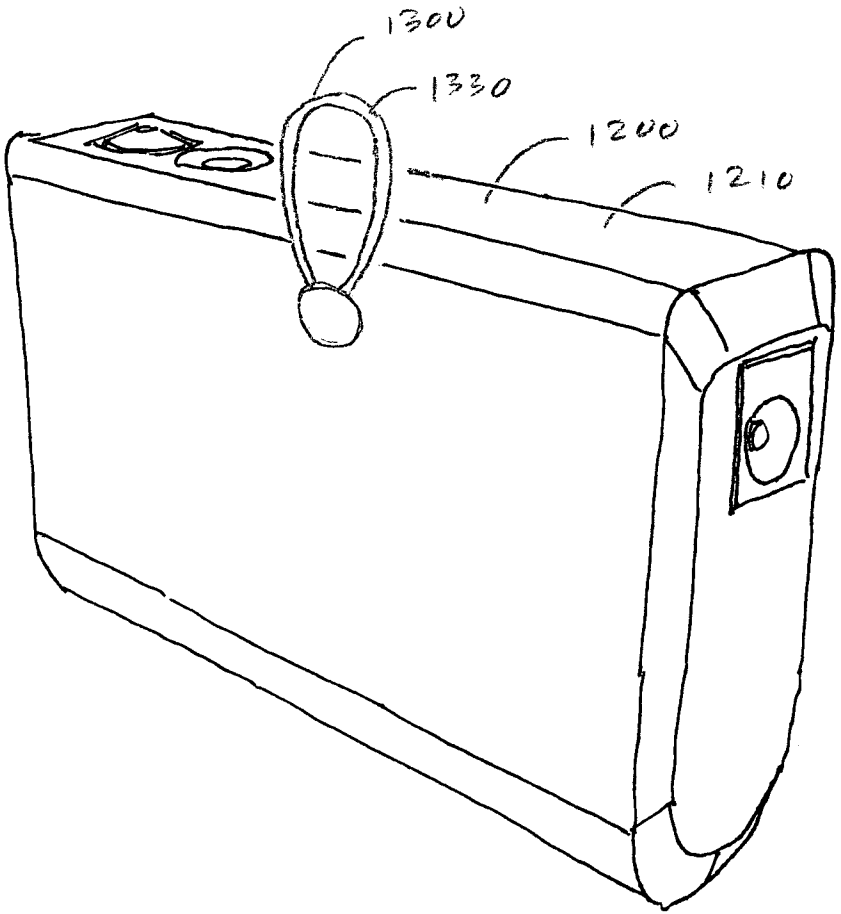

FIG. 2B shows another embodiment of an illumination device 1000 and a battery coupling device 1300. Battery coupling device 1300 may include a button coupling 1330. Button coupling 1330 may be configured to be coupled to a button on an article of clothing worn by a user. Button coupling 1330 may include a piece of fabric with one or more buttonholes configured to be coupled to a button. Button coupling 1330 may include one or more loops of string configured to be coupled to a button. Button coupling 1330 may include a piece of string with a loose end, configured to be wrapped one or more times around a button. Button coupling 1330 may be configured to be coupled to an article of clothing that includes include one or more buttons configured to be coupled to button coupling 1330. For example, a shirt may include one or more buttons located in a vicinity of a back of a collar, an upper back portion, or any other part of the shirt where a user desires to couple battery 1200.

Figure 3A:
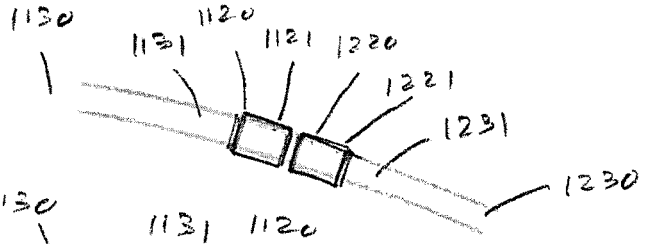
FIGS. 3A-3B show embodiments of a light connector 1120 and a battery connector 1220.
Figure 3B:
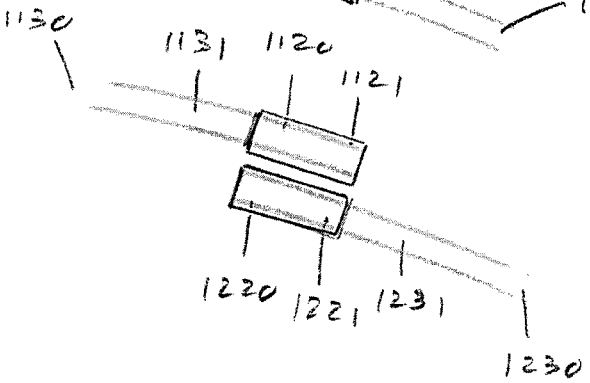

FIGS. 3A-3B show embodiments of light connector 1120 and battery connector 1220. Light connector 1120 may include a magnetic connector 1121. Battery connector 1220 may include a magnetic connector 1221. Magnetic connectors 1121 and 1221 may be coupled tip-to-tip as shown in FIG. 3A, in an overlapping configuration as shown in FIG. 3B, or any other suitable fashion. Magnetic connectors 1121 and 1221 may be configured to couple to each other when brought in proximity with each other. One or both magnetic connectors 1121 and 1221 may include magnets and/or ferromagnetic materials which generate sufficient magnetic attraction to attract and couple to each other when brought in proximity or contact with each other.

In use, when light 1100 is worn by a user, and battery 1200 and battery coupling device 1300 are also worn, magnetic connectors 1121 of light 1100 are brought into proximity with magnetic connectors 1221 of battery 1200, and magnetic connectors 1121 and magnetic connectors 1221 attract each other and become coupled to each other. This may be accompanied by an audible and/or tactile feedback such as a click or a snap. The use of magnetic connectors 1121 and 1221 may facilitate the coupling of light connector 1120 and battery connector 1220 by reducing the need for manual alignment and/or coupling, especially in areas that cannot be visualized directly by a user, such as the sides of the head. The use of magnetic connectors 1121 and 1221 may allow the coupling of light connector 1120 and battery connector 1220 without being able to see light connector 1120 and battery connector 1220, in a "blind" fashion.

The use of light connector 1120 and battery connector 1220 allows the eyewear, mask, or headwear to be changed without removing battery 1200. The use of light connector 1120 and battery connector 1220 allows the option of using other batteries, such as batteries worn on the belt.

Figure 4A:
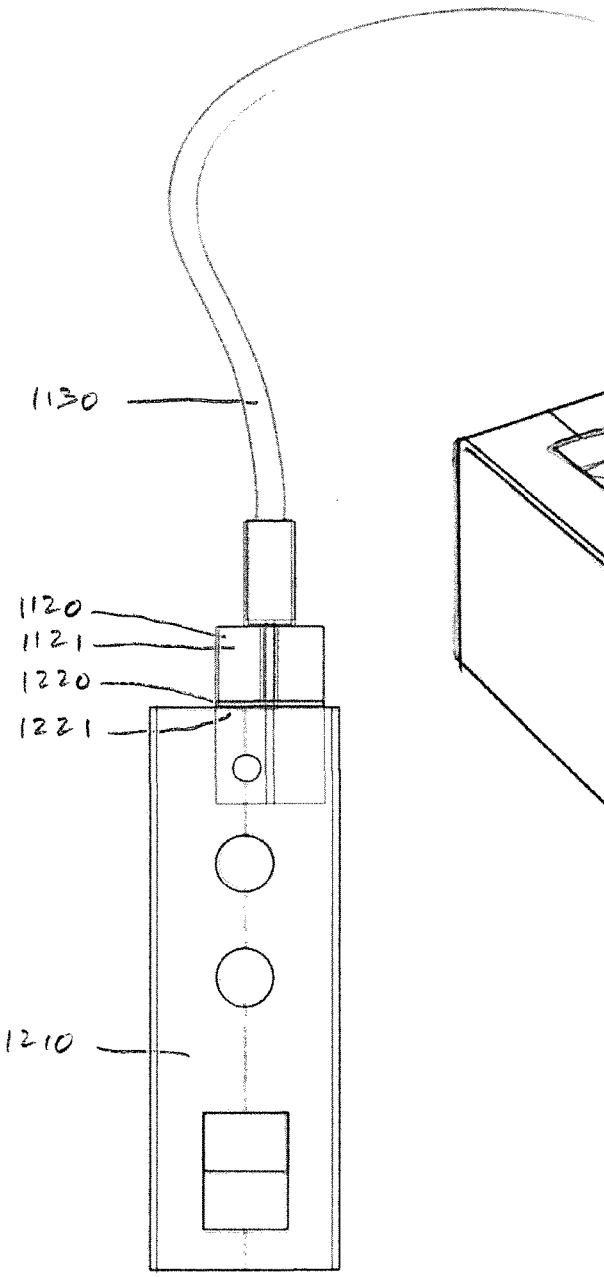
FIGS. 4A-4C show another embodiment of a battery housing 1210 with a battery connector 1220.
Figure 4B:
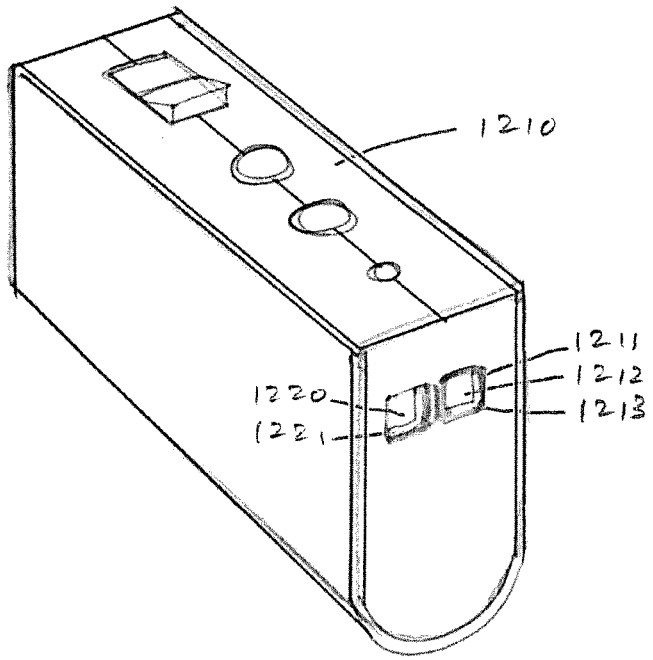
Figure 4C:
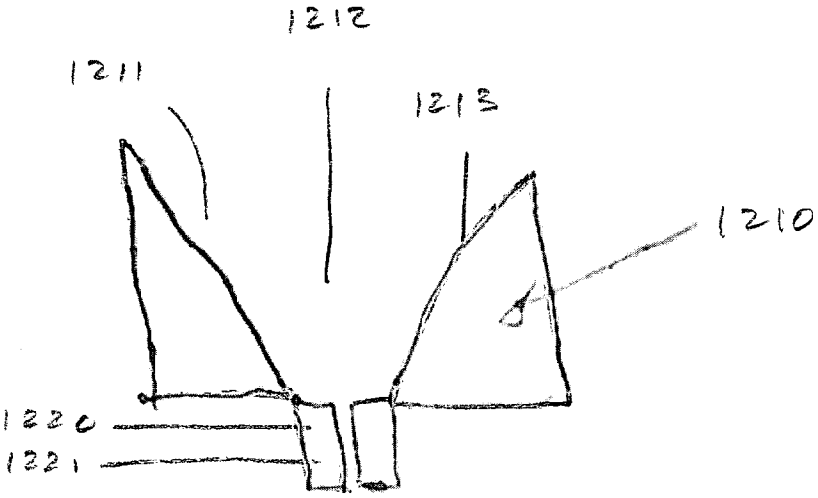

FIGS. 4A-4C show another embodiment of a battery housing 1210 with a battery connector 1220. FIG. 4A shows a top view of battery housing 1210 coupled to a light connector 1120. FIG. 4B shows a perspective view of battery housing 1210. FIG. 4C shows an enlarged view of battery connector 1220. In this embodiment, battery connector 1220 may be part of battery housing 1210. Battery housing 1210 may include a guide 1211. Guide 1211 may include a recess 1212 with walls 1213 that are angled to guide or funnel light connector 1120 to battery connector 1220. Light connector 1120 may include a magnetic connector 1121. Battery connector 1220 may include a magnetic connector 1221. The use of magnetic connectors 1121 and 1221 may allow the coupling of light connector 1120 and battery connector 1220 without being able to see light connector 1120 and battery connector 1220, in a "blind" fashion.

While the foregoing has been with reference to particular embodiments of the invention, it will be appreciated by those skilled in the art that changes in these embodiments may be made without departing from the principles and spirit of the invention.

What is claimed is:

1. An illumination device, comprising:

a light configured to coupled to eyewear, the light having a light connector;

a battery configured to be coupled to the light, the battery configured to be positioned behind a head of a user, the battery having a battery connector configured to be coupled to the light connector; and a first arm and a second arm coupled to the battery, the first arm and the second arm configured to be placed on a first side and a second side of the head of the user, the first arm and the second arm configured to extend forward from the battery and fit over ears of the user and grip the first side and the second side of the head of the user.

2. The illumination device of claim 1, wherein the battery connector is positioned at or near an end of the first arm and/or the second arm.

3. The illumination device of claim 1, wherein the battery connector is integral with the first arm and/or the second arm.

4. The illumination device of claim 1, wherein the light connector includes a magnetic connector.

5. The illumination device of claim 1, wherein the battery connector includes a magnetic connector.

6. A method of using an illumination device, the method comprising:

coupling a light to a head of the user, the light having a light connector;

positioning a battery behind the head of the user, the battery having a battery connector configured to be coupled to the light connector;

placing a first arm and a second arm on a first side and a second side of the head of the user, wherein the first arm and the second arm are coupled to the battery and extend forward from the battery and fit over ears of the user; and coupling the light connector and the battery connector.

7. An illumination device, comprising:

a light configured to coupled to eyewear, the light having a light connector;

a battery configured to be coupled to the light, the battery configured to be positioned behind a neck of a user, the battery having a battery connector configured to be coupled to the light connector; and a first arm and a second arm coupled to the battery, the first arm and the second arm configured to be placed on a first side and a second side of the neck of the user.

8. The illumination device of claim 1, wherein the first arm and the second arm are arcuate.

9. The illumination device of claim 1, wherein the first arm and the second arm are elongate.

10. The illumination device of claim 7, wherein the first arm and the second arm are arcuate.

11. The illumination device of claim 7, wherein the first arm and the second arm are elongate.

* * * * *